US005248151A

United States Patent [19]

Pickup

[11] Patent Number: 5,248,151

[45] Date of Patent: Sep. 28, 1993

[54] RETRACTABLE POINT SYSTEM FOR A DART

[76] Inventor: Jeffrey Pickup, 145 Rembrandt Place, London, Ontario, Canada, N6C 5G9

[21] Appl. No.: 926,934

[22] Filed: Aug. 10, 1992

[51] Int. Cl.[5] ..... A63B 65/02

[52] U.S. Cl. ..... 273/420

[58] Field of Search ..... 273/420, 419, 416

[56] References Cited

U.S. PATENT DOCUMENTS 4,230,322 10/1980 Bottelsen ..... 273/420

4,697,815 10/1987 McKenna ..... 273/420

FOREIGN PATENT DOCUMENTS 2228211 8/1990 United Kingdom ..... 273/419

*Primary Examiner*—Paul E. Shapiro

[57] ABSTRACT

A novel dart is equipped with a dart point contraction system which allows the dart point to contract into the body or barrel of the dart as when the dart point impacts wire, or staples and the like which surmount boundaries of denominated regions of a dartboard. The dart body defines a cylindrical cavity into which the downstream end of the dart point can reciprocatingly travel since it also is cylindrical and comes to rest against the dart body at the end of its travel. It is as a result of the kinetic energy of flight that even though the dart point may have impacted a boundary wire or even a denominated region of the dartboard, that "bounce-out" is inhibited by the cylindrical portion of the dart point travelling in the cylindrical cavity of the dart body when impact occurs.

4 Claims, 2 Drawing Sheets

RETRACTABLE POINT SYSTEM FOR A DART

This invention relates to darts, as used in a game of skill, now universally known and played around the world as both a leisure and as a competitive sport or game.

BACKGROUND TO THE INVENTION

A prior art device is disclosed in a U.S. Pat. No. issued Oct. 6, 1987 as U.S. Pat. No. 4,697,815 to one McKenna for a DART. That particular patent describes a tapered point which is seized, in its forward and extended position, by a collar which has a thread to matingly thread into a threaded portion in a cylindrical-like cavity defined by the dart body. The machining of the threaded collar and female mating thread in the body is expensive; furthermore, the construction of a fully tapered point, with the butt end, is also expensive. Another dart with retractable point is disclosed by Bottlesen in his U.S. Pat. No. 4,230,322 issued Oct. 28, 1980.

It is an object of the invention to eliminate such threads and as substitution to provide a split sleeve in frictional engagement with a step bore defined by the dart body as means for retaining the point in the dart body, during flight, while allowing the point to reciprocatingly travel within the dart body and, when it is in the dart point outwardly extended position, to lock against the split sleeve so as to lock it in outward engagement. When the dart point hits a denominated dartboard region, it penetrates it; while, if the dartpoint hits a boundary wire surmounted on the dart board partitioning two denominated regions, the kinetic energy of the dart body causes the downstream end of the dart point to migrate into the cylindrical cavity defined by the dart body while applying a constant pressure, during this migration, on the dart point due to the momentum of the dart point against the wire, encouraging the point to travel over the wire and thus, to penetrate into a denominated region of the dartboard; this reducing "bounce-out".

In a similar fashion, when a dart is flung, it impacts a denominated region directly, the aforesaid action still eliminates "bounce-out" should the point tip be dull or otherwise damaged.

The primary object of the invention to accomplish the aforesaid with, simplicity, enhancing manufacturing efficiency, by way of the construction of a less expensive product which eliminates threads and the like or, other machining means, adapted to constrain the point in a forward position.

It is another object of the invention to allow or enable the reduction in diametrical size of the dart body or dart barrel saving dart weight and materials and achieving better flight characteristics.

It is a further object of the invention to move the center of gravity of the dart more forward than those of similar "bounce-resistant" darts and closer to the front of the dart barrel or body. This assists in better flight characteristics for the dart since the flights of the dart has a better chance to migrate the dart on its steady path of travel.

It is a further object of the invention to provide that the dart body defines a cylindrical recess and the dart point have its downstream end essentially cylindrical, adapted to frictionally travel, in a reciprocating fashion, within the cylindrical recess while allowing the dart point to have a taper, for penetration purposes, at its forward or upstream end into a dartboard. The cylindrical sizing of the downstream end of the dart point and of the cylindrical cavity is such that the cavity stabilizes the dart point in its radial directions so that the point is always, essentially, in the prolongation of the cylindrical axis of the body, i.e., the tip does not wobble.

SUMMARY OF THE INVENTION

The invention achieves the retraction of the dart point on impact onto wires or staples fastened to a dartboard to effectively minimize loss of darts due to "bounce out" when the dart point impacts these wires or metal staples that surmount the bristle fibre denominated regions of the dartboard; the wires and staples act as boundaries to the denominated regions.

The invention also achieves retraction of the dart point, each time that the dart point itself strikes the fibrous denominated regions, or if first hits a boundary wire, the point retraction allows the kinetic energy of the barrel to sustain pressure of the tip on the wire "encouraging" the tip to slide off and to penetrate an adjacent denominated region of the board, thus eliminating "bounce-out".

The invention therefore achieves a dart comprising:

(a) a cylindrical-like body defining a step bore that communicates with one end thereof, the other end carrying a flight;

(b) a dart point having a tapered shaft portion that terminates in a forward point, the tapered shaft at its opposite end stepping through a shoulder into a cylindrical segment;

(c) wherein the step bore has a major and minor bore, the minor bore sized slightly larger than the cylindrical portion of the dart point whereby to allow frictional engagement therewith and to permit the dart point to travel to and from within said minor bore; and, (d) a split annular sleeve sized to nest in said major bore, defining a cylindrical channel sized a diameter smaller than the minor bore, and having rearward shoulders, whereby the tapered shaft portion of the dart point is adapted to extend through the sleeve and in its forward extension, to engage against the rearward shoulders of the sleeve urging the sleeve in an outwardly radial direction against the inner diameter of the major bore to thereby constrain the sleeve and the dart point in the body.

More particularly, the dart has a preferred cylindrical segment of length D that is approximately 20% of the total length of the dart point and the minor bore has a length greater than the distance D with a diameter fractionally larger than ⅛ of an inch.

BRIEF DESCRIPTION OF THE DRAWINGS

The invention will now be described by way of example and with reference to the accompanying drawings in which:

Referring to FIG. 1, the dart 10, according to the invention, consists of a cylindrical-like body or barrel 11; which, in this figure, is shown as truncated oblate ellipsoid 11, which has a forward aperture 12 carrying therein a novel split ring collar 13 through which extends a retractable dart point 14 having a forward or upstream point 15 for penetration into a dartboard or the like. The body 11 extends rearwardly, and can be slightly tapering, into a shaft or stem 16 carrying flights 17.

Referring to FIG. 3, the dart point 14 has a tapered or conical shaft portion 19, that at its upstream end, tapers into a penetrating point or tip 15. The downstream end of the conical taper 19 terminates at an annular shoulder 21 but extends downstream into a cylindrical shaft portion 20 that is dimensioned a distance, D, which represents approximately 20% of the total length of the dart point 14.

Figure 2:
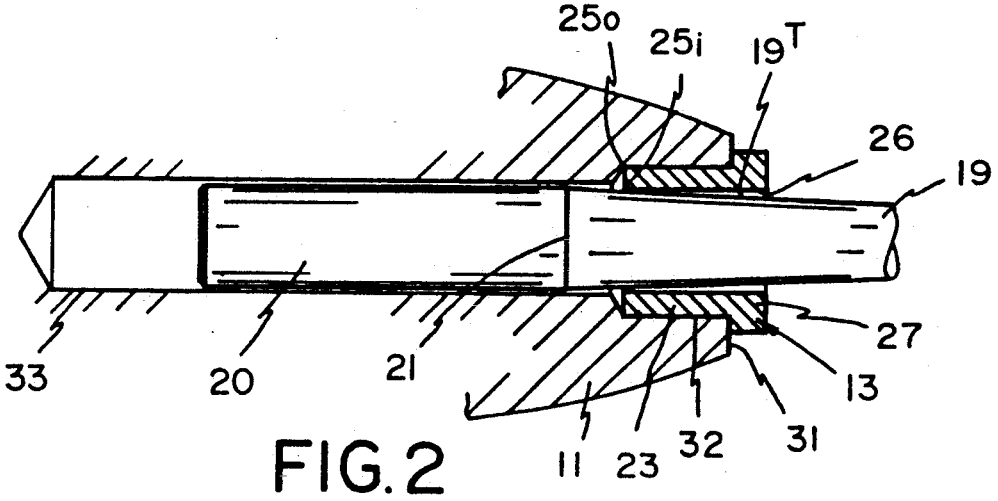
FIG. 2 is of a partial sectional view of the point in the cylindrical cavity defined by the dart body and showing the frictional interface between the novel circumscribing split sleeve and the outer shoulder of the dart point.

Referring to the partial sectional view of FIG. 2, the body 11 terminates at a front annular face 31 that defines a step bore, a forward major bore 32 concentric with and stepping into a longer cylindrical minor bore 33. The minor bore 33 is sized slightly larger than the diameter of the cylindrical portion 20 of the dart point 14 so as to allow the dart point 14 to reciprocatingly travel in the minor bore 33, whose walls act as a bearing surface against the cylindrical portion 20 allowing reciprocation of the dart point 14 to and from, as will be described.

Figure 4:
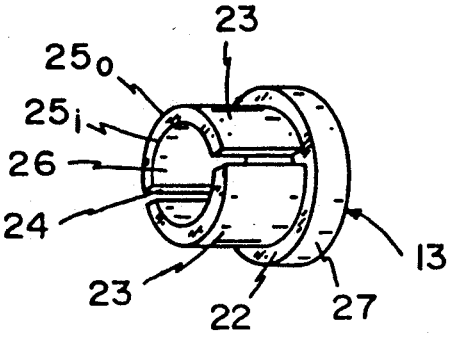
FIG. 4 is a perspective view of the novel split sleeve.

Referring to FIGS. 2 and 4, the split sleeve 13 is in frictional engagement with the major bore 32. The split sleeve 13 defines a forward collar or annulus 27 with an inner shoulder 22 having split semi-circular cylindrical portions 23 with an outside diameter $25_o$ and an inside diameter $25_i$, the latter of which is concentric with a bore 26 defined by extending through the split sleeve 13. The outside diameter of the semi-cylindrical portions 23 preferably should be of constant diameter.

Figure 3:
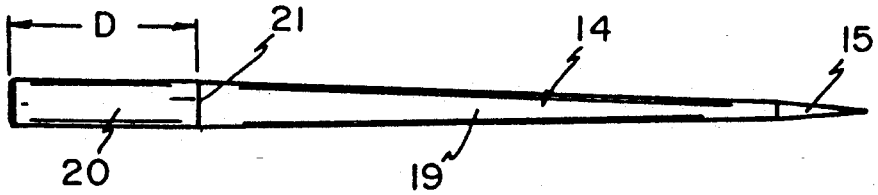
FIG. 3 is a side view, exaggerated, of the dart point.

In either case, the outer diameter $25_o$ is slightly larger than the inner diameter of the major bore 32 so as to make a frictional sealing, engagement therewith, while the inner diameter $25_i$ is slightly smaller than the diameter at the annular shoulder 21 of the dart point 14, as shown in FIGS. 2 and 3. When the dart point 14 is in its extended outward position of FIGS. 1 and 2, that is also the operational dart-throwing position of the dart point 14. The diameter of the cylindrical portion 20 of the dart point 14 is larger than diameter $25_i$ so that when the dart point 14 is in its outward extended position, as aforesaid, a radial segment 19' of the tapered portion 19 engages against the inner diameter $25_i$ expanding the split ring radially outward so that its outer diameter $25_o$ urges and fixes itself into the walls of the major bore 32' constraining not only the split sleeve 13 in the dart body 11 but also, the dart point 14.

When the dart point 14 is retracted into the major bore 33, as by impact against the dartboard or the like, the outward urging by the taper 19 against the inner peripheral diameter $25_i$ of the split sleeve 13 no longer exists. This removes the outward diametrical pressure on the distal end 25 of the sleeve 13 and removes the frictional engagement of the outer diameter $25_o$ of the sleeve 13 against the inner diameter of the major bore 32. Outward radial pressure on the split sleeve 13 is relieved and it may be removed from the body of the dart by convenient tool 50, shown in FIGS. 5 and 6, which allows easy removal of the dart point system from the barrel 11. The tool, together with the profile of the cylindrical bore 33, the shape of the tip 14 and the split sleeve 13 provide a convenient means of removing a damaged dart point tip 15, if the same is damaged as by falling on concrete floors or, sometimes, even striking the boundary wires of the dart board.

Figure 1:
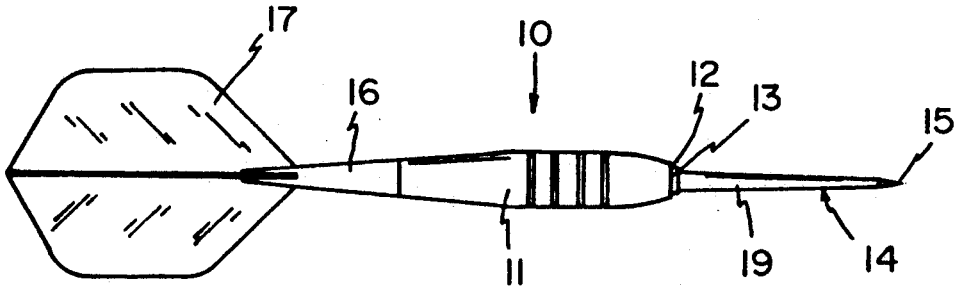
FIG. 1 is a perspective view of the dart.
Figure 5:
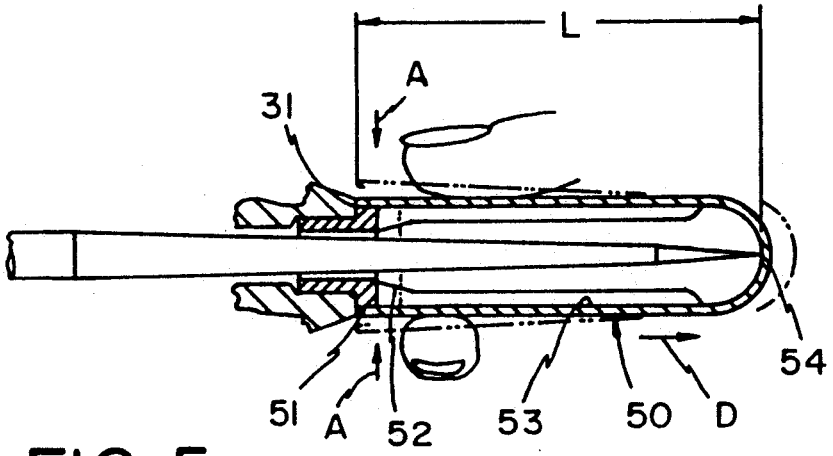
FIG. 5 is a partial sectional view of a tool for removal of the novel point system; and, FIG. 6 is a perspective view of the tool of FIG. 5.
Figure 6:
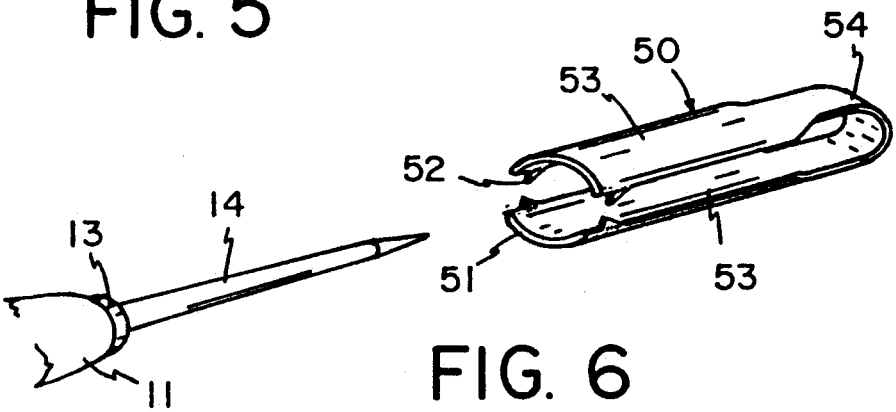

Referring to FIGS. 5 and 6, the removal tool 50 is but a single sheet of formed metal having two arms 53 interconnected at their respective proximate ends by a curve or convex portion 54 and terminating at distal end 51, which provide a step bore at the interface 51 and 52 so, when, and now referring to FIG. 5, the ends are depressed in the direction of the arrows toward each other in the direction of arrows A and the tool 50 is pulled in the direction of arrow D, and provided that the tapered portion 19 of the tip 14 is free of the inner diameter 25' of the split sleeve 13, the split sleeve 13 may be removed from the barrel by pulling it in the direction D. If the length L is chosen correctly, and is slightly "less" than the total extent by which the point 14 protrudes, as shown in FIGS. 1 and 2, from the barrel 11 when the taper 19 urges against the inner circumference $25_i$ of the sleeve, the forward motion of the tool, in the direction opposite to that of arrow D, while it is in the process of being engaged over the sleeve 13, will put pressure, by the concave portion 54 on the tip 15, and push the point 14 into the barrel 11 relieving the outward radial pressure of the tapered portion 19 on the sleeve portions $25_i$.

I claim:

1. A dart comprising:

(a) a cylindrical-like body with opposite ends, the body defining a stepped inner major and minor bores that mutually communicate with one another, the major bore communicating to one end of the body, the other end carrying a flight;

(b) a dart point having a tapered shaft portion that terminates in a forward point, the tapered shaft at its opposite end stepping through a shoulder into a cylindrical segment;

(c) the minor bore sized slightly larger than the cylindrical portion of the dart point adapted to allow frictional engagement therewith and to permit the dart point cylindrical segment to travel to and from, in close sliding juxtaposition and within said minor bore; and, (d) a split annular sleeve sized to nest in said major bore, defining a cylindrical channel sized a diameter smaller than the minor bore, and cylindrical segment, and having rearward shoulders, whereby a major extent of the tapered shaft portion of the dart point is adapted to extend through and beyond the sleeve and which, in its forward extension, a circumferential segment of the tapered shaft portion is adapted to engage against the rearward shoulders of the sleeve urging the sleeve in an outwardly radial direction against the inner diameter of the major bore to thereby constrain the sleeve and the dart point in the body.

2. The dart, as claimed in claim 1, wherein the cylindrical segment has a length D that is approximately 20% of the total length of the dart point.

3. The dart, as claimed in claim 2, wherein the minor bore has a length greater than distance D.

4. The dart, as claimed in claim 3, wherein the diameter of the cylindrical segment is ⅛ inch.

* * * * *